US006551019B1

(12) United States Patent
Mötz et al.

(10) Patent No.: US 6,551,019 B1
(45) Date of Patent: Apr. 22, 2003

(54) DEVICE FOR CHECKING THE COMPACTION FOR VIBRATION COMPACTION DEVICES

(75) Inventors: Karl Hermann Mötz, Nörterhausen (DE); Uwe Blancke, Koblenz (DE)

(73) Assignee: Bomag GmbH & Co. oHG, Boppard (DE)

( * ) Notice: Subject to any disclaimer, the term of this patent is extended or adjusted under 35 U.S.C. 154(b) by 21 days.

(21) Appl. No.: 09/721,534

(22) Filed: Nov. 22, 2000

(30) Foreign Application Priority Data

Nov. 26, 1999 (DE) ..... 199 56 943

(51) Int. Cl.[7] ..... E01C 19/28; G01N 3/40

(52) U.S. Cl. ..... 404/117; 702/137; 73/78; 73/573; 73/594

(58) Field of Search ..... 404/117, 122; 73/78, 573, 594, 660; 702/137

(56) References Cited

U.S. PATENT DOCUMENTS 4,149,253 A * 4/1979 Paar et al. ..... 404/117 X
6,113,309 A * 9/2000 Hollon et al. ..... 404/84.5

FOREIGN PATENT DOCUMENTS

DE 3590610 C2 6/1986
WO WO9302253 2/1993
WO WO9715726 5/1997
WO WO9817865 4/1998

* cited by examiner

*Primary Examiner*—David Bagnell
*Assistant Examiner*—Sunil Singh
(74) *Attorney, Agent, or Firm*—Baker & Hostetler LLP

(57) ABSTRACT

A device for checking the compaction, in particular, of black top pavement in street and roadway construction, using a vibration roller drum that is provided with a compaction checking device is provided. In the compaction of black top pavement, the measurement methods of the dynamic ground rigidity, known from ground compaction, for determining the condition of compaction that has been achieved, can not be used since the asphalt rigidity varies between two measurements with the temperature and in addition, the underground rigidity is measured with it proportionately. In order to solve these problems, a second vibration roller drum is provided which has a second compaction checking device, whereby the second vibration roller drum is coupled to the first vibration roller drum essentially following it in the same track. In this way, for the comparison of the values determined, the temperature dependence of the measurement values determined is eliminated. Furthermore, an evaluation unit is present, which compares the measurement results of the two compaction checking devices. In this way, the underground rigidity is eliminated in the measurement values.

6 Claims, 2 Drawing Sheets

10
9
12
13
1
5
11
3
6
7
8

DEVICE FOR CHECKING THE COMPACTION FOR VIBRATION COMPACTION DEVICES

BACKGROUND

The invention involves a device for checking the compaction, in particular, of black top pavement in street and roadway construction, using a vibration roller drum that is provided with a compaction checking device.

It is well-known in the prior art that when processing the ground using compaction devices, a more economic execution of the construction work is possible through the use of constant compaction checks. Customarily, these compaction checking devices are based on the method of measuring the reflections of the vibrations which are transferred by the compaction device during vibrational compaction of the ground. Hardly any vibrational energy is reflected back by a very loose material, but on the other hand, ground that is already greatly compacted or in the extreme case, a massive concrete slab, returns almost the entire vibrational energy back to a vibration roller drum.

Compaction checking devices of this type can, for example, be impulse transducers attached to the roller frame, which act together using an acceleration measurement process with a statistical performance.

By an acceleration transmitter of this type on the roller frame, however, impact forces might also be registered which occur when the vibrating tires of a vibration roller drum work the surface to be compacted.

If for compaction checking devices of this type, the compaction no longer changes in spite of an increasing amount of compaction passages, the intended highest density has been achieved with this specific compaction device. This density has already been exceeded if the value determined decreases again, since a loosening of the ground is occurring.

Compaction checking devices of this type reach their limits, however, when they are applied to compacting black tops:

In determining the dynamic ground rigidity on asphalt layers with the known methods described above, the rigidity and thus the density of the asphalt layer can thus not be determined exactly, since the rigidity of the asphalt layer is a function of the temperature to a large extent. An exact temperature measurement of the asphalt layer is not possible. In particular, the surface temperature of the asphalt layer, which is easy to determine, can not be taken as a measure for the temperature of the entire layer, because, among other reasons, the temperature of the surface is too greatly dependent on environmental influences such as the prevailing wind or rain, which have, however, no effect on the temperature on the inside of the asphalt layer.

Finally, the values determined in the black top structure when it is traveled over by known compaction checking devices are not meaningful enough with regard to the dependence of the dynamic rigidity of the asphalt layer on the temperature that is prevalent in it.

In particular, this rules out the method that has been pursued until now in ground compaction, in which the values determined when first traveled over by a vibration roller drum that has a compaction checking device are stored, and then compared to the values determined when traveled over for a second time, in order to make conclusions about the compaction from the differences. The temperature changes in the asphalt layer occurring between the two passages with one machine have an effect that can not be compensated for.

SUMMARY

The object of the invention presented here is thus to further develop a device for checking compaction so that it also produces measurement data and results for black top in street and roadway construction, which do not have the disadvantages mentioned above.

This object is achieved according to the invention in that the device for checking the compaction has a second vibration roller drum that is provided with a second compaction checking device and which is coupled to the first vibration roller drum essentially following it exactly in its track whereby an evaluation unit is present which compares the measurement results of the two compaction checking devices.

The invention has the advantage that by the second vibration roller drum being coupled to the first vibration roller drum, the passage of the second roller drum follows immediately after the first so that the time period between the two passages can be neglected with regard to a temperature change in the asphalt layer. Furthermore, by the evaluation unit that is present, which compares the measurement results of the two compaction checking devices arranged in the first or second vibration roller drums, effects can also be compensated for, when because of the measurement depths present, the rigidity of the underground lying below the asphalt layers is proportionately measured at the same time. This effect of the underground rigidity can be eliminated by the subtraction of differences in the measurement results during the comparison.

The invention is thus also based on the realization that the change of the asphalt rigidity is a quite good reference value for the increase in the compaction progress of the asphalt.

By the coupling of the two vibration roller drums according to the invention, which allows the second roller drum to essentially follow the first roller drum in the same track, an additional peculiarity is taken into account in black top construction, which represents a considerable difference from the customary ground compaction using vibration roller drums: Whereas in customary compaction operations, the individual compaction paths are next to each other track to track in parallel, in black top construction, in order to prevent the formation of grooves, a looped and meandering drive path is selected, which can normally not be reproduced in a separate second passage.

By the coupling of the two vibration roller drums in the same track, this problem is solved.

As most advantageous, this coupling in the same track can be achieved in a tandem roller. However, it is also within the context of the invention to provide the vibration roller drums in two separate single drum rollers, which can then be coupled together especially via a computer-supported tracking process. In this computer-supported tracking process, for example, a satellite-supported Global Positioning System (GPS) can be accessed. The two single drum rollers driven one after the other can also, however, be coupled together via radar, ultrasound, infrared, etc. Of course, a rigid coupling using a rod is also possible.

It has also proven to be advantageous that the two compaction checking devices can be calibrated in order to then be able to offset differences in recording the measurement values. In particular, it is proposed for the calibration to set the two vibration roller drums on elements with known and/or equal dynamic rigidities, for example, blocks made of elastic material, and then to adjust the resulting measurement values.

For the values determined during the compaction process, the evaluation unit should advantageously contain an additional delay element, with which the measurement results of the first compaction checking device are to be stored intermediately so that they can be compared with the measurement values of the second compaction checking device at the identical measurement location.

It is clear that the retention time of the delay element is dependent on the driving speed and the separation distance of the two vibration rollers that are coupled together.

BRIEF DESCRIPTION OF THE DRAWINGS

Additional advantages and characteristics of the invention are explained in the following description of a preferred embodiment. Shown in the drawings are:

In FIG. 1, a compaction device is shown in the form of a known tandem roller with two vibration rollers, which externally has a customary design. The compaction device has a front roller drum 1, which is attached on the front assembly 2*a*, on which the driver's cab of the tandem roller is also located, and a rear roller drum 3, which is part of the rear assembly 2*b*, which also contains the drive motor of the compaction device. In order to steer this tandem roller, the two assemblies 2*a* and 2*b* are connected to each other via a articulated center pivot steering joint 4.

In FIG. 2, a diagram is shown in which it will be recognized that the front roller drum 1 is provided with a first compaction checking device 5, and the second vibration roller drum 3 is provided with a second compaction checking device 6. These compaction checking devices 5 and 6 operate in the manner known for ground compaction, in which they determine the dynamic ground rigidity. They thus determine in the example depicted here the total dynamic rigidity both of the asphalt layer 7 compacted by them, as well as also proportionately the rigidities of the underground 8 located beneath, which has already been compacted.

Figure 1:
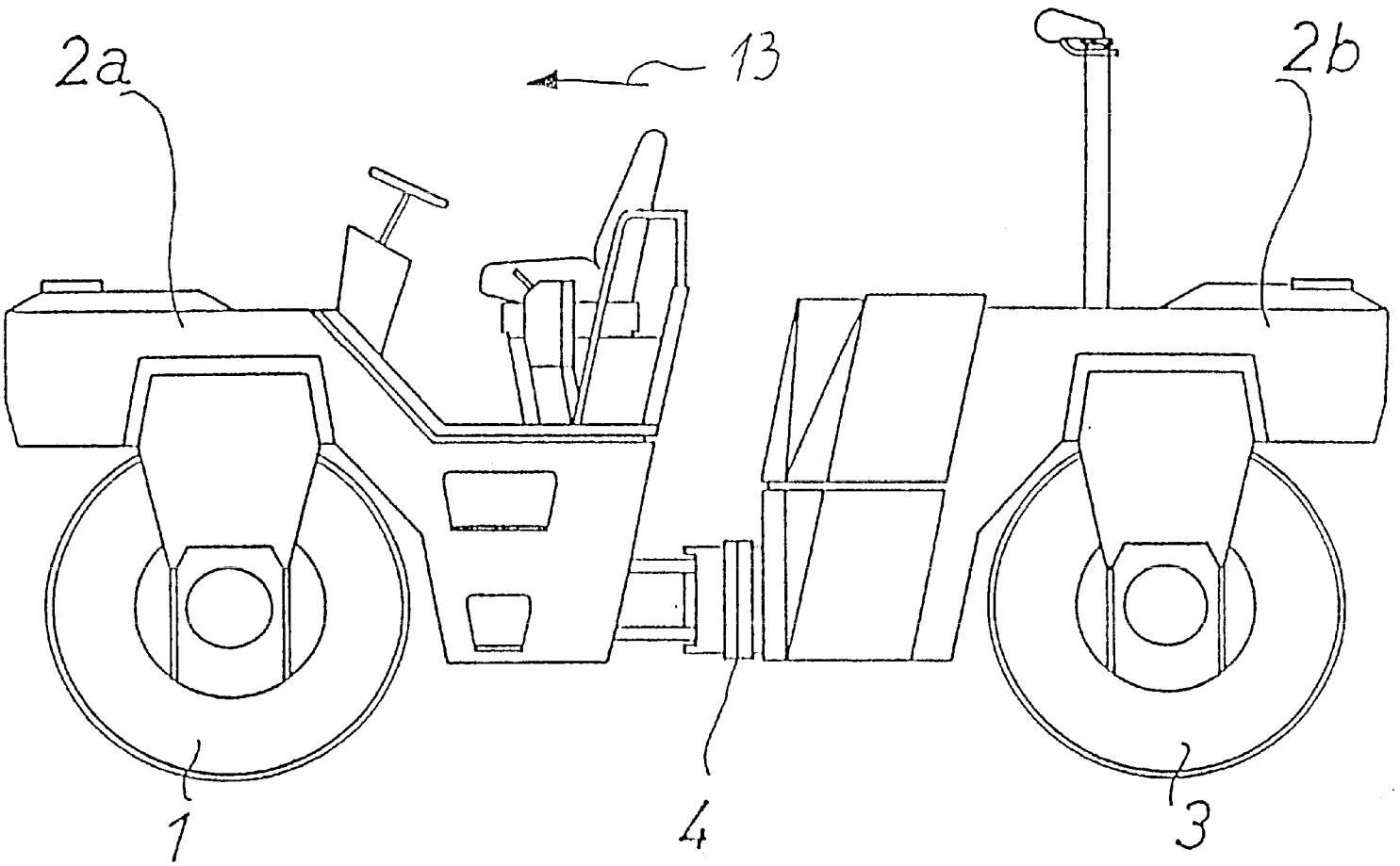
FIG. 1 is a side view of a compaction device, in which a device according to the invention is provided.

The total dynamic rigidities determined by the two compaction checking devices 5 and 6 are passed on as measurement results to an evaluation unit 9, which compares the measurement results obtained from the front and the rear compaction checking device. In this way, by comparing the measured rigidity at the front and rear roller drums, the increase of the rigidity resulting from the passages of the roller drums is determined. If the increase is small, the compaction of the asphalt layer 7 can be assumed to be concluded.

Since the front roller drum 1 and the rear roller drum 3 are coupled via the assemblies 2*a* and 2*b* at a relatively short separation distance between them, only a very small period of time passes between the times when the front roller drum 1 and the rear roller drum 3 travel over the same place, so that the temperature of the asphalt, upon which the rigidity of the asphalt layer depends, in addition to the compaction, does not change. The values determined with the first and the second compaction checking devices are thus, since they were determined at quasi the same temperature, independent of the temperature.

By subtraction in the evaluation unit 9, the effect of the underground rigidity is also eliminated. The result determined by the evaluation unit 9 on a display device 10 is thus a direct measure for the compaction of the asphalt layer 7 that is achieved.

This display device 10, can for example, be a pointer instrument, or even a light emitting diode display, for displaying the compaction difference, which signals a sufficient or not yet sufficient compaction, similar to a traffic light.

Figure 2:
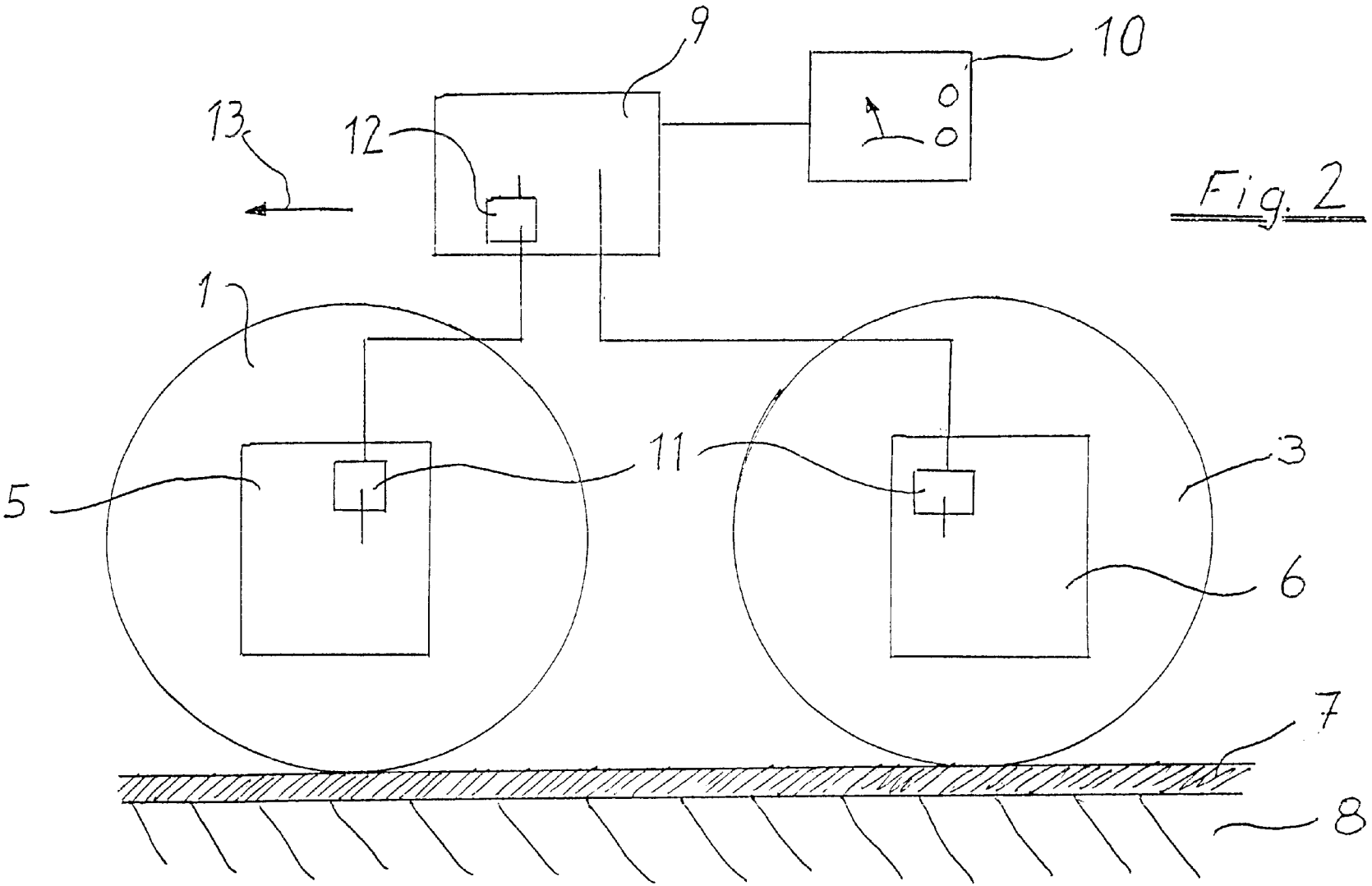
FIG. 2 is a schematic diagram, on which the compaction checking devices are shown in relation to the evaluation unit.

In order to be able to compare the measurement values produced by the compaction checking devices 5 and 6 directly to each other in the example presented here, calibration elements 11 are additionally provided in order to offset roller-specific differences in the checking devices. Using these calibration elements 11, for example, different roller weights can be compensated. In order to, in addition, compare the measured value determined by the roller drum 1 or 3 for the same ground position using the display unit 10, an additional delay element 12 is integrated in the evaluation unit 9. Its retention duration for the delayed passing on of the measurement value determined by the front roller drum 1 is dependent on the separation distance between the front roller drum 1 and the rear roller drum 3 as well as on the speed corresponding to the arrow 13 in FIGS. 1 and 2.

It should also be mentioned that the roller 3 in the example depicted here follows roller drum 1 essentially in the same track, because of the mechanical coupling in the assembly 2 and the articulated center pivot steering joint 4, so that for the values determined with the two roller drums 1 and 3, measurement values are involved at respectively identical positions.

What is claimed is:

1. Device for checking compaction of black top pavement, comprising a first vibration roller drum (1) with a first compaction checking device (5) arranged therein, and a second vibration roller drum (3) with a second compaction checking device (6) arranged therein, the second vibration roller drum (3) is coupled to the first vibration roller drum (1) such that it follows in approximately the same track, and an evaluation unit (9) which relieves signals from the first and second compaction checking devices and compares measurement results of the two compaction checking devices (5, 6).

2. Device according to claim 1 wherein the roller drums are coupled to form a tandem roller.

3. Device according to claim 1, wherein the vibration roller drums are located in two separate single drum rollers, which are coupled together via a computer-supported tracking process.

4. Device according to claim 1, wherein the two compaction checking devices (5, 6) are calibrated (11).

5. Device according to claim 1, wherein the evaluation unit (9) includes a delay element (12), with which the measurement results of the first compaction checking device (5) are intermediately stored for the comparison with the measurement results of the second compaction checking device (6) from the same measurement location.

6. Device according to claim 1, wherein an optical display unit (10) is connected to the evaluation unit (9).

* * * * *